United States Patent [19]

Yoshida

[11] Patent Number: 4,776,293

[45] Date of Patent: Oct. 11, 1988

[54] AUTOMATIC NEEDLE THREAD SUPPLY CONTROL SYSTEM FOR A SEWING MACHINE

[76] Inventor: Noriyuki Yoshida, 5-301-1, Tsuchihara, Tenpaku-ku, Nagoya-shi, Aichi-ken, Japan

[21] Appl. No.: 69,517

[22] Filed: Jul. 2, 1987

[30] Foreign Application Priority Data

Jul. 9, 1986 [JP] Japan ..... 61-161086

[51] Int. Cl.[4] ..... D05B 47/04

[52] U.S. Cl. ..... 112/302; 112/254

[58] Field of Search ..... 112/302, 254, 255, 278, 112/229, 97, 59, 235

[56] References Cited

U.S. PATENT DOCUMENTS

| | | | |
|---|---|---|---|
| 4,215,641 | 8/1980 | Dobrjanskyj et al. | 112/302 X |
| 4,289,087 | 9/1981 | Takenoya et al. | 112/254 |
| 4,408,554 | 10/1983 | Takiguchi | 112/302 |
| 4,565,143 | 1/1986 | Hanyu et al. | 112/254 X |

*Primary Examiner*—Peter Nerbun

*Attorney, Agent, or Firm*—Barnes & Thornburg

[57] ABSTRACT

A sewing machine system is disclosed for accurately controlling the amount of supply of a needle thread to a thread take-up member from a thread supplying source in response to various conditions of sewing.

The system controls supply and withholding of the needle thread with an accurate timing by putting an electrostrictive element into operation or non-operation in relation to a parameter signal on sewing conditions and a synchronizing signal derived from the timing of rotation of the arm shaft of sewing machine.

7 Claims, 8 Drawing Sheets

AUTOMATIC NEEDLE THREAD SUPPLY CONTROL SYSTEM FOR A SEWING MACHINE

BACKGROUND OF THE INVENTION

1. Field of the Invention

The present invention relates to an automatic needle thread supply control system for a sewing machine capable of automatically controlling the amount of supply of a needle thread to a thread take-up member from a thread supplying source in response to various conditions of sewing.

2. Description of the Prior Art

An apparatus described in the U.S. Pat. No. 4,215,641 is proposed as the conventional automatic needle thread supply control system for a sewing machine. In the system, a needle thread clamping means is constituted so as to comprise a solenoid, and the needle thread is clamped by exciting the solenoid and the needle thread is released by demagnetizing the solenoid, and thereby supply and stop of the needle thread is controlled.

However, when a sewing machine is operated at a high speed, the operating time of the needle thread clamping means allowed for clamping and releasing the needle thread becomes short, and excitation and demagnetization are required to be performed in a short time. However, because of having a peculiar delay of operation, the solenoid sometimes cannot respond accurately to a signal commanding switch-over to excitation or demagnetization. Consequently, it cannot control accurately the amount of supply of the needle thread, and a problem remains that no beautiful seam line is formed because of variation in the tightened state of each seam.

Furthermore, since the solenoid has to be kept excited over a period during which the needle thread is clamped, such problems are raised that the solenoid is heated and consumes a relatively high power.

SUMMARY OF THE INVENTION

The first object of the present invention is to provide an automatic needle thread supply control system for a sewing machine which can accurately control the amount of supply of the needle thread even at a high-speed operation of the sewing machine and can form a beautiful seam line.

The second object of the present invention is to provide a reliable automatic needle thread supply control system for a sewing machine which eliminates a danger of heating and operates at a low power consumption.

To attain the above-described objects, the present invention has a basic configuration as shown in FIG. 11, and hereinafter description is made on that configuration.

An automatic needle thread supply control system for a sewing machine in accordance with the present invention has a synchronizing signal generating means generating a synchronizing signal in synchronism with rotation of a main shaft of the sewing machine, a parameter signal generating means generating a parameter signal on various conditions of sewing, a needle thread clamping device operating for supply and withholding of the needle thread to the thread take-up member from the thread supplying source, an electrostrictive element operatively connected to the needle thread clamping device to operate the needle thread clamping device, an arithmetic operation controlling means generating a control signal for controlling supply and stop of the needle thread based on the parameter signal and the synchronizing signal, a first electric circuit for applying a voltage to the electrostrictive element to deform by an electrostriction thereof, and a second electric circuit for releasing the electrostrictive deformation of the electrostrictive element, and provides an electrostrictive element driving circuit driving both electric circuits according to the control signal.

Since the present invention is constituted as described above, when the parameter signal generating means generates the parameter signal on various sewing conditions, the operation controlling means calculates the control signal based on the parameter signal and the synchronizing signal generated by the synchronizing signal generating means, and the electrostrictive element driving circuit drives the first and the second electric circuits by that control signal, and executes an electrostrictive deformation of the electrostrictive element and the release thereof. The electrostrictive element displaces the needle thread clamping device by this electrostrictive deformation or release. As a result, the needle thread clamping device can accurately perform supply and stop of the needle thread at a high speed in synchronism with each rotation of a main shaft of the sewing machine.

As is obvious from the above-described, the present invention employs an electrostrictive element having a high-response speed to operate the needle thread clamping device performing supply and stop of the needle thread to the thread take-up member from the needle thread supplying source, and therefore the supply and stop of the needle thread can be switched over rapidly and accurately even at a high speed operation of the sewing machine, the amount of supply of the needle thread can be controlled accurately, and a uniform and beautiful seam line can be formed.

Furthermore, the electrostrictive element needs not to consume power to hold the amount of displacement after it has been charged and displaced, and effects an elimination of a danger of heating inside the frame of the sewing machine and a long period of maintenance of a reliable supply of the needle thread.

DESCRIPTION OF THE PREFERRED EMBODIMENTS

Hereinafter, detailed description is made on one embodiment in accordance with the present invention based on drawings.

Figure 6:
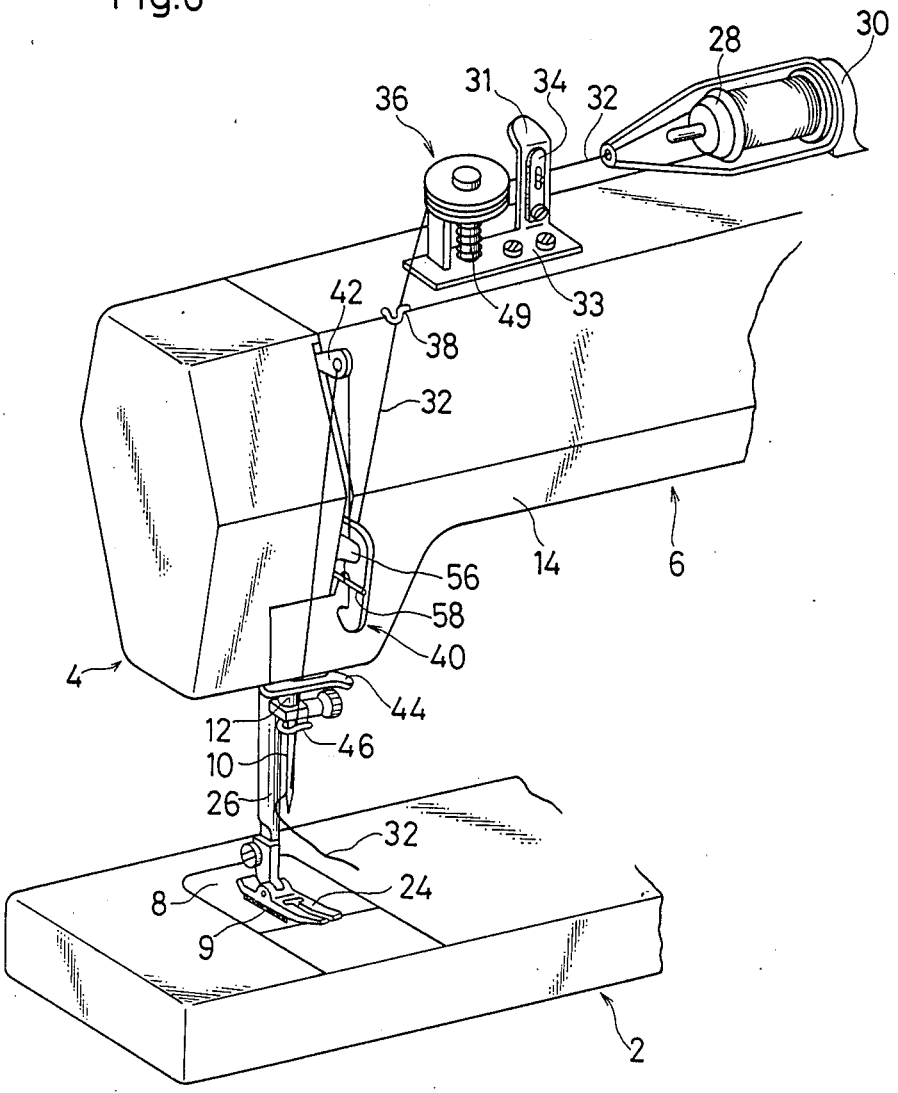
FIG. 6 is a perspective view showing the vicinity of a head unit of the above-mentioned sewing machine.

FIG. 6 is a perspective view showing the vicinity of a head unit of this sewing machine, and a support leg (not illustrated) is erected on a work supporting bed 2, and an arm 6 at one end of which a head unit 4 is installed is supported horizontally by this support leg. On the head unit 4, a needle bar 12 is installed which is swung right and left by a swinging mechanism (not illustrated) and is moved up and down by a main shaft 22 as described later, and on the work supporting bed 2, a throat plate 8 is installed, and a feed dog 9 driven by a feeding mechanism (not illustrated) appears on the surface of the work supporting bed 2 penetrating through this throat plate 8. In cooperation with the above-mentioned needle bar 12 and feed dog 9, a predetermined seam is formed on a work fabric 37 as described later.

Figure 1:
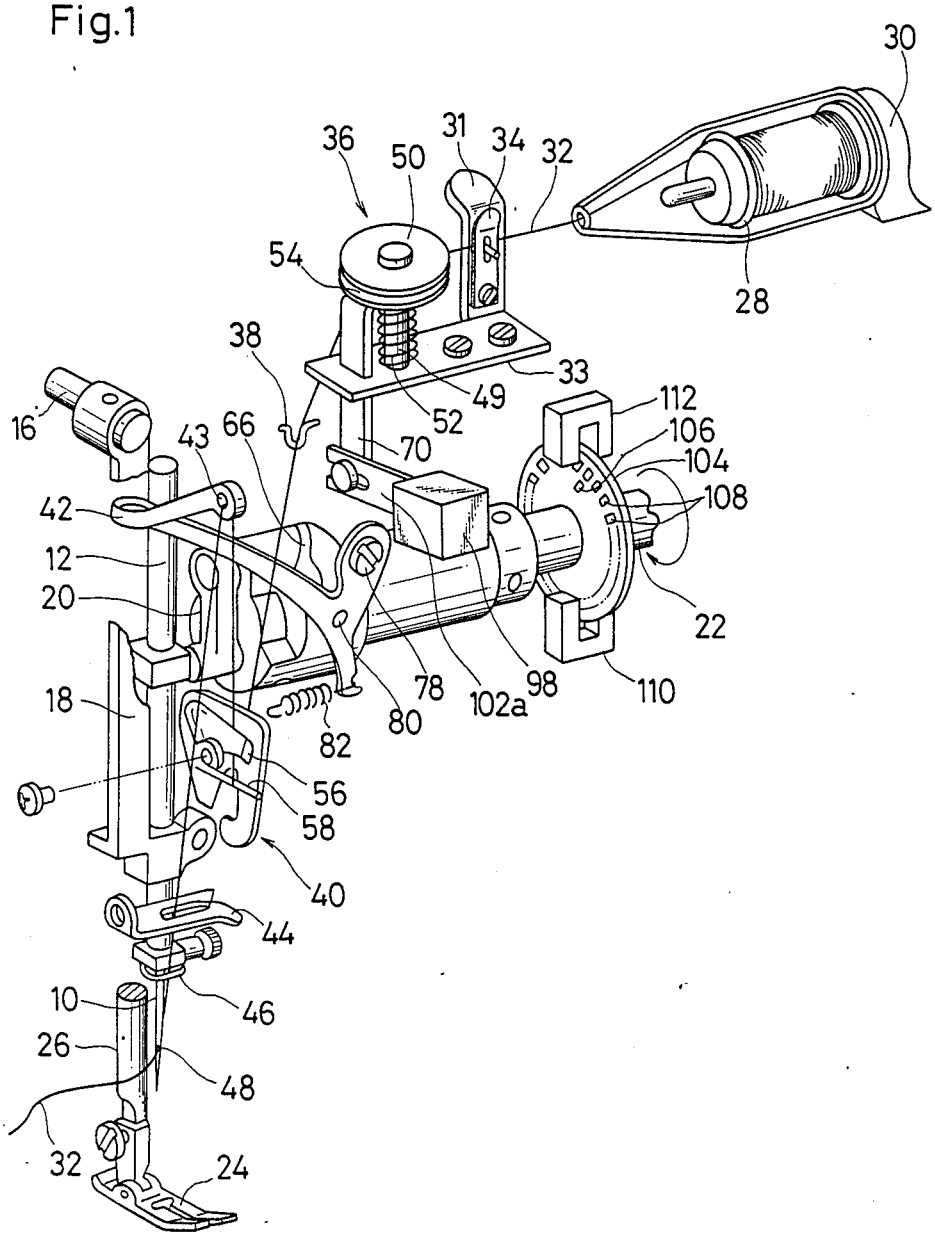
FIG. 1 is a perspective view showing an inner mechanism of a sewing machine with a machine frame removed, wherein one embodiment in accordance with the present invention is adopted.
Figure 7:
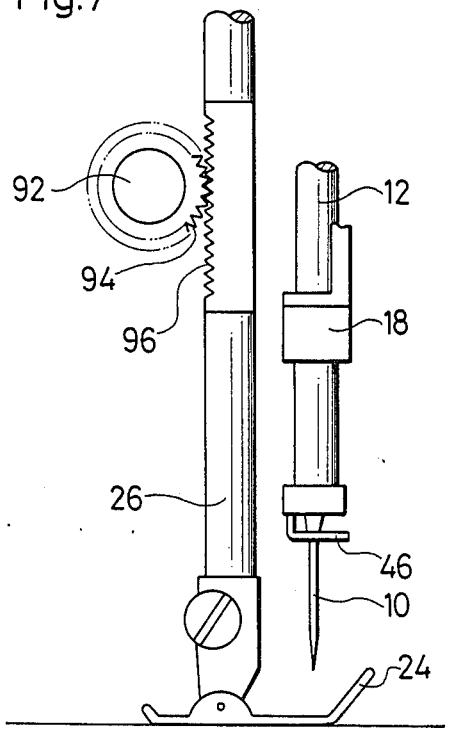
FIG. 7 is a side view showing a presser bar and a potentiometer of the above-mentioned sewing machine.

FIG. 1 is a view showing an inner mechanism in the vicinity of the head unit 4 of the sewing machine as shown in FIG. 6. In the figure, the needle bar 12 providing a needle 10 at the bottom end thereof is supported so as to be movable up and down by a needle bar guide 18 installed so as to be capable of swinging around a pin 16 fixed to a frame 14 of sewing machine (not illustrated in FIG. 1), and is driven up and down by the main shaft 22 through a crank arm 20. A presser bar 26 on the bottom end of which a presser foot 24 is mounted is positioned at the ascending position and the descending position by a mechanism (not illustrated), and at the descending position the work fabric 37 is attached to the frame 14 so as to be pressed with a predetermined pressure. Then, a potentiometer 92 is mounted on the frame 14 as shown in FIG. 7 to detect the thickness of the work fabric 37 clamped between the top surface of the work supporting bed 2 and the presser foot 24, and a gear 94 mounted on an output shaft of the potentiometer 92 is engaged with a rack 96 installed at the intermediate part of the presser bar 26, and the potentiometer 92 is constituted so as to generate a voltage on the thickness of the work fabric 37.

To the frame 14, that is, the top surface of the head unit 4, a needle thread holder 30 whereon a needle thread spool 28 being a needle thread supplying source of this embodiment is mounted and a base plate 33 providing a guide plate 31 and a needle thread clamping device 36 are fixed, and a needle thread 32 drawn out from the needle thread spool 28 comes to a guide hole 43 formed at the top part of a take-up lever 42 via a pre-tension spring plate 34, the needle thread clamping device 36, a first guide 38 and a second guide 40, and from this point, it is further laced through an eye 48 of the needle 10 via a third guide 44 fixed to the frame 14 and a fourth guide 46 fixed to the needle bar 12. The above-mentioned pre-tension spring plate 34 gives a predetermined sliding resistance to the needle thread 32 by the energizing force thereof. Also, the needle thread clamping device 36 provides an upper disc 50 supported by a bar 49 fixed to the base plate 33 and a lower disc 54 energized toward the upper disc 50 by a spring 52, and by clamping the needle thread 32 between the upper disc 50 and the lower disc 54, the supply is stopped, and by moving a connecting member 70 against the energizing force of the spring 52, the needle thread 32 is supplied.

Furthermore, the above-mentioned second guide 40 provides a pre-tension spring plate 56 and a spring arm 58, and thereby a predetermined sliding resistance is given to the needle thread 32 and a cut of the thread is prevented even if the tension of the needle thread rises high temporarily. For example, the maximum tension thereof is set between the tension at which the #30 cotton thread is cut and the tension required for sewing denim fabric of 5 mm in thickness.

Figure 2:
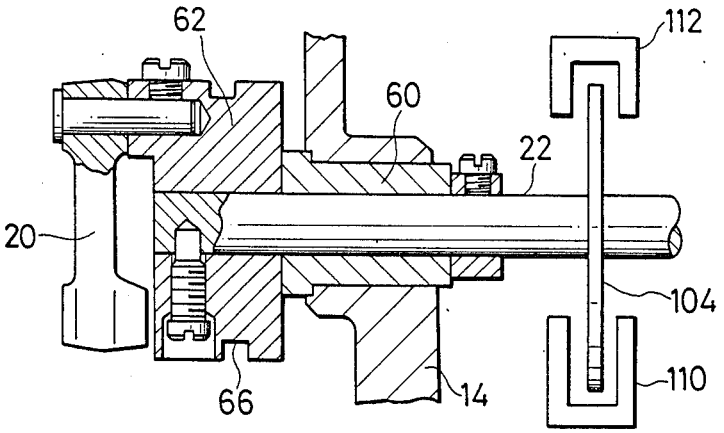
FIG. 2 is a fragmental cross-sectional view showing a cam member and a disc mounted on a main shaft of the sewing machine.

As shown in detail in FIG. 2, the end part of the main shaft 22 is supported rotatably by the frame 14 through a bearing bush 60, and a cam member 62 is fixed to the tip end part of the main shaft 22 so as to be able to rotate relatively. An annular groove 66 is formed in a predetermined curve on the peripheral surface of this cam member 62, and the side wall surface in the groove 66 functions as a cam surface controlling the motion of the take-up lever 42.

Figure 3:
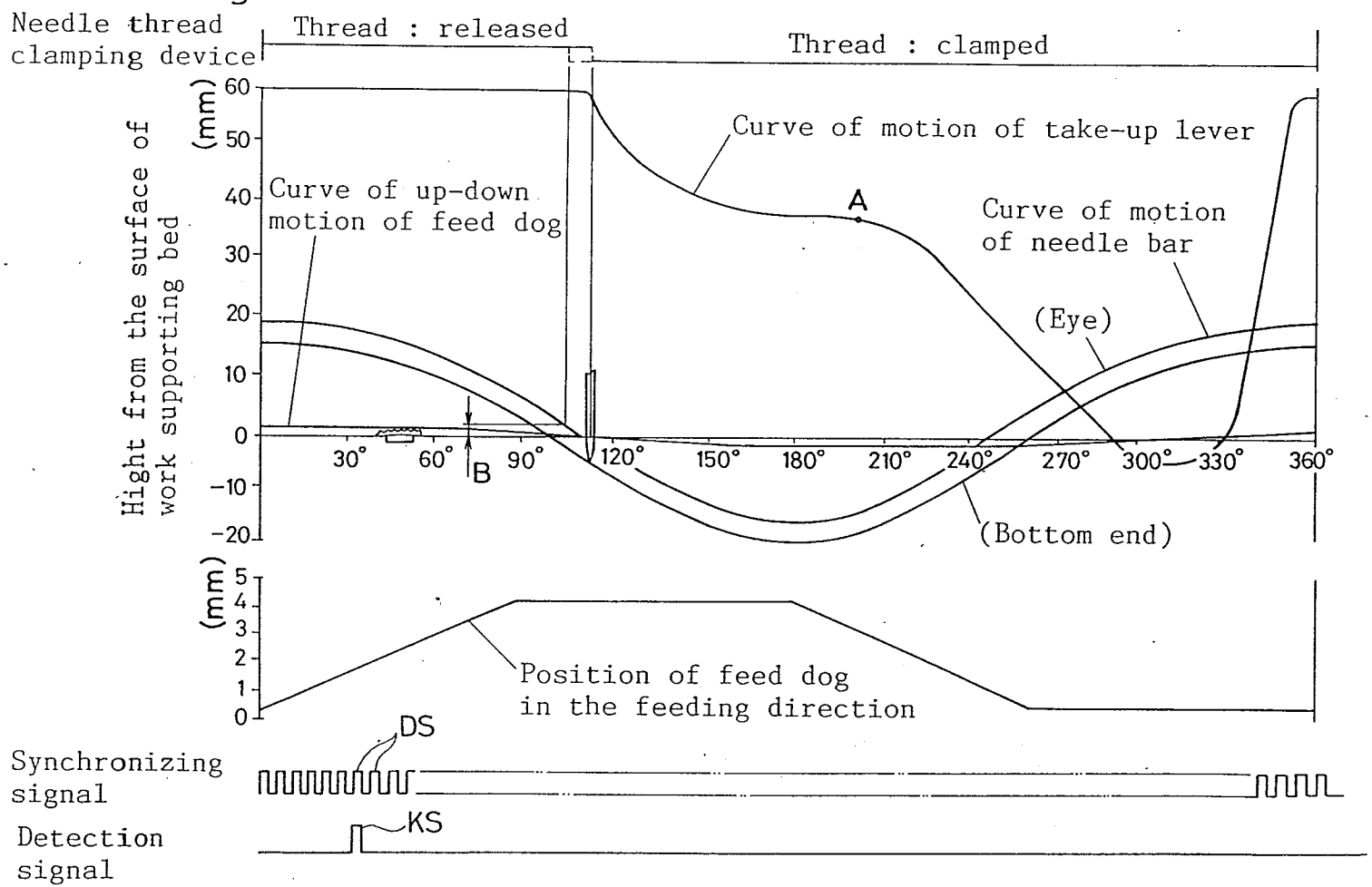
FIG. 3 is a time chart showing operation of each part of the above-mentioned sewing machine.

The above-mentioned take-up lever 42 is equivalent to the thread take-up member of this embodiment, and the base end part thereof is mounted rotatably on the frame 14 by a pin 78. Also, a cam follower 80 fitted into the annular groove 66 is installed in the fixed manner at the base end part of the take-up lever 42, and as shown in a time chart in FIG. 3, the take-up lever 42 is moved up and down along a locus corresponding to the shape of the annular groove 66 taking timing with the rotation of the main shaft 22. A ccil spring 82 energizing the take-up lever 42 upward is installed between the base end part of the take-up lever 42 and the frame 14 so that the operation of lifting the take-up lever 42 is made smoothly. In addition, FIG. 3 is a time chart showing operation of each part of the electronic lock stitch sewing machine, and in the figure, the abscissa shows the rotary phases of the main shaft 22 by rotary angles.

Also, a disc 104 is fixed to the main shaft 22, and a single first slit 106 and 72 second slits 108 are installed on different circumferences on the disc 104, respectively. Then, a position detector 110 detecting the first slit 106 and a synchronizing signal generator 112 detecting the second slits 108 are fixed to the frame 14, respectively.

Figure 8:
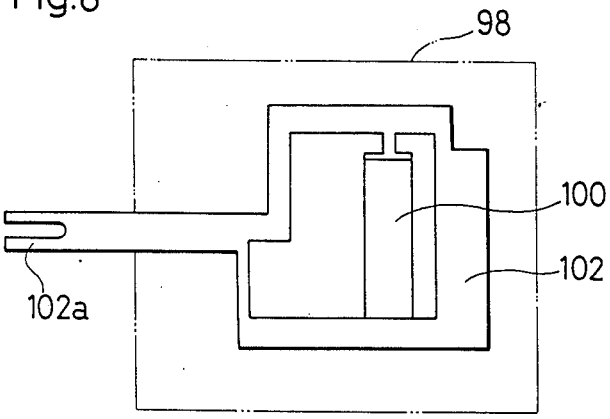
FIG. 8 is a view showing an inner configuration of a needle thread clamping device operating apparatus of the above-mentioned sewing machine.

Furthermore, in the frame 14, a thread clamping device operating apparatus 98 for controlling opening and closing of the above-mentioned thread clamping device 36 is disposed. As shown in FIG. 8, the thread clamping device operating apparatus 98 is constituted so as to comprise an electrostrictive element 100 and a publicly known mechanical amplifier 102 for mechanically amplifying the displacement thereof. The electrostrictive element 100 is constituted with a publicly known lamination type piezoelectric ceramics, and when a high voltage is applied, it displaces with a quick response of dozens of μsec, and the dimension is increased, and the mechanical amplifier 102 amplifies the amount of displacement of the electrostrictive element 100 to nearly 0.5 mm. Then, a tip 102*a* of the mechanical amplifier 102 projects from the thread clamping device operating apparatus 98, and engages with the connecting member 70, and releases the thread clamping device 36 by a displacement of the electrostrictive element 100 against the spring force of the spring 52, allowing the supply of the needle thread 32, that is, the passing of the needle thread 32.

Next, description is made hereinafter on an electric configuration of this embodiment.

The above-mentioned position detector 110 is constituted with a publicly known optical detector, and in a time chart in FIG. 3, the needle 10 descends from the uppermost point, and the first slit 106 of the above-mentioned disc 104 is detected when the rotary phase of the main shaft 22 reaches 30°, and at that time of detection, a high-level detection signal KS is generated.

The synchronizing signal generator 112 is equivalent to the synchronizing signal generating means, and is constituted with an optical detector similar to the position detector 110, and detects the second slits 108 of the disc 104, generating a high-level synchronizing signal DS. This means that since the second slits 108 are installed at 72 positions, 72 pulse signals are generated as the synchronizing signal DS at every rotation of the main shaft 22.

A parameter signal generator 114 is equivalent to the parameter signal generating means, being constituted with the above-mentioned potentiometer 92 and an A/D converter 116. Then, an analog signal of a level responding to the thickness of fabric generated from the potentiometer 92 is converted into a digital signal by the A/D converter 116, being outputted as a parameter signal PS.

An arithmetic operation controller 118 is equivalent to the arithmetic operation controlling means, and is constituted in a manner that the detection signal KS, the synchronizing signal DS and the parameter signal PS are supplied, processing operation is performed according to a flow chart as described later, and a control signal CS is generated by that processing operation.

Figure 9:
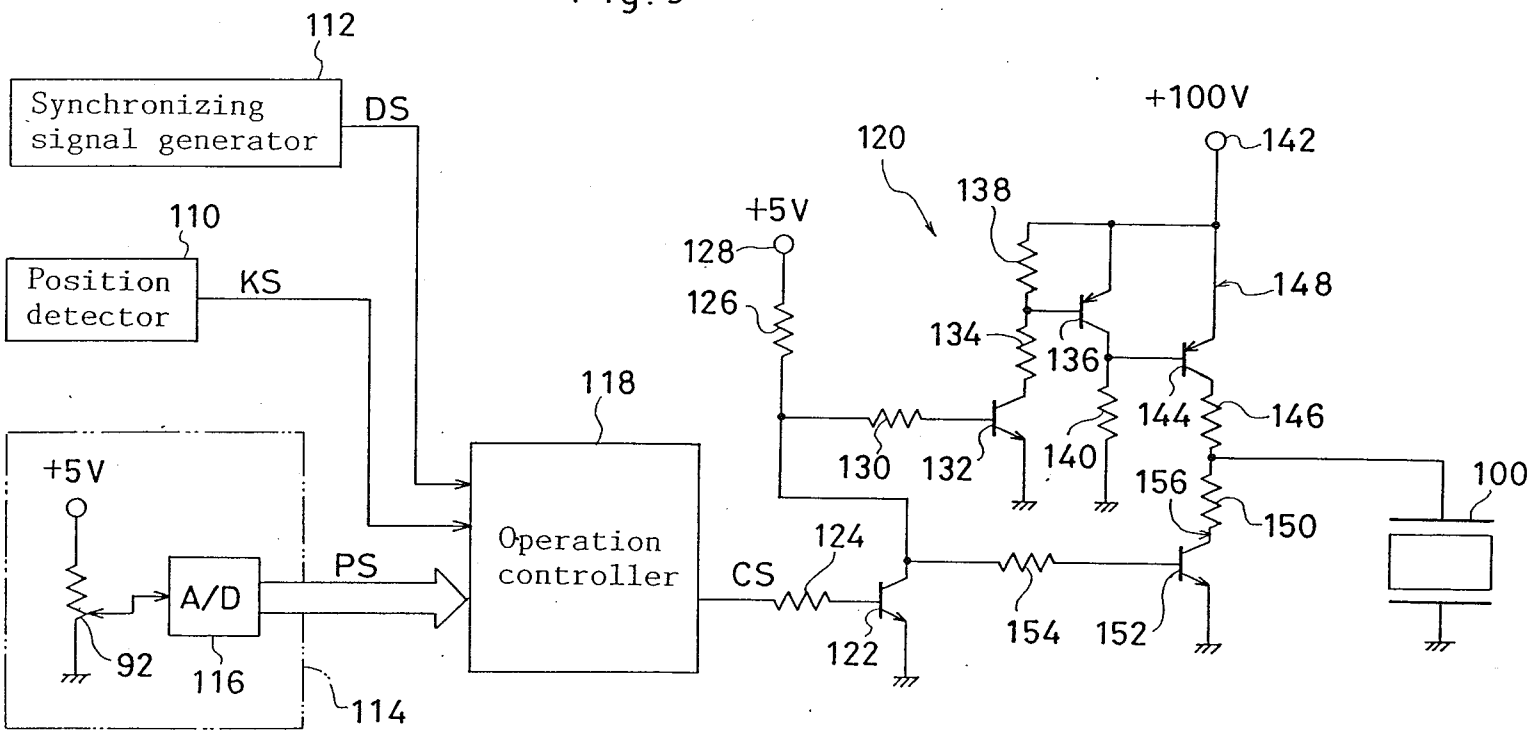
FIG. 9 is a block diagram showing an electric configuration of a needle thread supply control system of this embodiment.

As shown in FIG. 9, an electrostrictive element driving circuit 120 is constituted in a manner of comprising a large number of transistors.

In an NPN type transistor 122, the base thereof is connected to the arithmetic operation controller 118 through a resistor 124, the emitter thereof is grounded, and the collector thereof is connected to a terminal 128 of a 5 V DC power supply through a resistor 126. In an NPN type transistor 132, the base thereof is connected to the connection of the collector of the transistor 122 and the resistor 126 through a resistor 130, the emitter thereof is grounded, and the collector thereof is connected to the base of a PNP type transistor 136 through a resistor 134. In the transistor 136, the base thereof is connected to a terminal 142 of a 100 V DC power supply through a resistor 138, the emitter thereof is connected to the terminal 142 thereof, and the collector is grounded through a resistor 140. In a PNP type transistor 144, the emitter thereof is connected to the terminal 142 of the DC power supply, the base is connected to the connection of the collector of the transistor 136 and the resistor 140, and the collector is connected to one end of the electrostrictive element 100 through the resistor 146, and the other end of the electrostrictive element 100 is grounded. Then, an electric path having the transistor 144 and the resistor 146 which are connected between one end of the electrostrictive element 100 and a DC power supply 142 constitutes a first electric circuit 148, and the electric circuit 148 is installed to charge the electrostrictive element 100 by applying a DC voltage of 100 V to the electrostrictive element 100, and by this charge the electrostrictive element 100 is displaced and the dimension thereof is increased.

In an NPN type transistor 152, the collector is connected to the connection of the electrostrictive element 100 and the resistor 146 through a resistor 150, the emitter is grounded, and the base is connected to the collector of the transistor 122 through a resistor 154. Then, an electric path having the resistor 150 and the transistor 152 which are connected in parallel to the both ends of the electrostrictive element 100 constitutes a second electric circuit 156, and an electric path 156 is installed to discharge the charge electrostrictive element 100 during a fixed period substantially shorter than a period of the synchronizing signal DS, and by this discharge the electrostrictive element 100 is contracted and the dimension thereof is restored.

Description is made on operation of this embodiment having the configuration as described above.

First, when the sewing machine is stopped, the operator clamps the work fabric 37 between the throat plate 8 and the presser foot 24, and then the presser bar 26 ascends by the thickness of the work fabric, and the gear 94 engaged with the rack 96 installed in the presser bar 26 is rotated, and the potentiometer 92 supplies a voltage of the level on the thickness of the work fabric 37 to the A/D converter 116. The A/D converter 116 converts an analog signal from the potentiometer 92 into a digital signal, outputting it as the parameter signal PS.

Also, when the sewing machine is stopped, the arithmetic operation controller 118 generates the high-level control signal CS, supplying it to the base of the transistor 122. Thereby, the transistor 122 is held in the on-state, the transistors 132 and 136 are put in the off-state due to cuts of the base currents thereof, and the transistor 144 is put in the on-state by supplying the base current. Furthermore, because the above-mentioned transistor 122 is in the on-state, the base current of the transistor 152 is cut and the transistor 152 is put in the off-state. This means that the first electric circuit 148 is closed and the second electric circuit 158 is opened, and the electrostrictive element 100 is supplied with a DC voltage of 100 V through the transistor 144 and the resistor 146, being charged (electrostrictive deformation), and the dimension thereof is increased. At this time, the electrostrictive element 100 is charged until the voltage across the terminals thereof rises to 100 V, and this charged voltage is held, and therefore once charged, the collector current of the transistor 144 becomes small and power is scarcely consumed. Then, the amount of displacement of the electrostrictive element 100 is amplified by the mechanical amplifier 102, and the connecting member 70 connected to the tip **102*a* is moved by the amount responding to the amount of displacement against the spring force of the spring 52, and the needle thread clamping device 36 releases the needle thread 32**.

Figure 10:
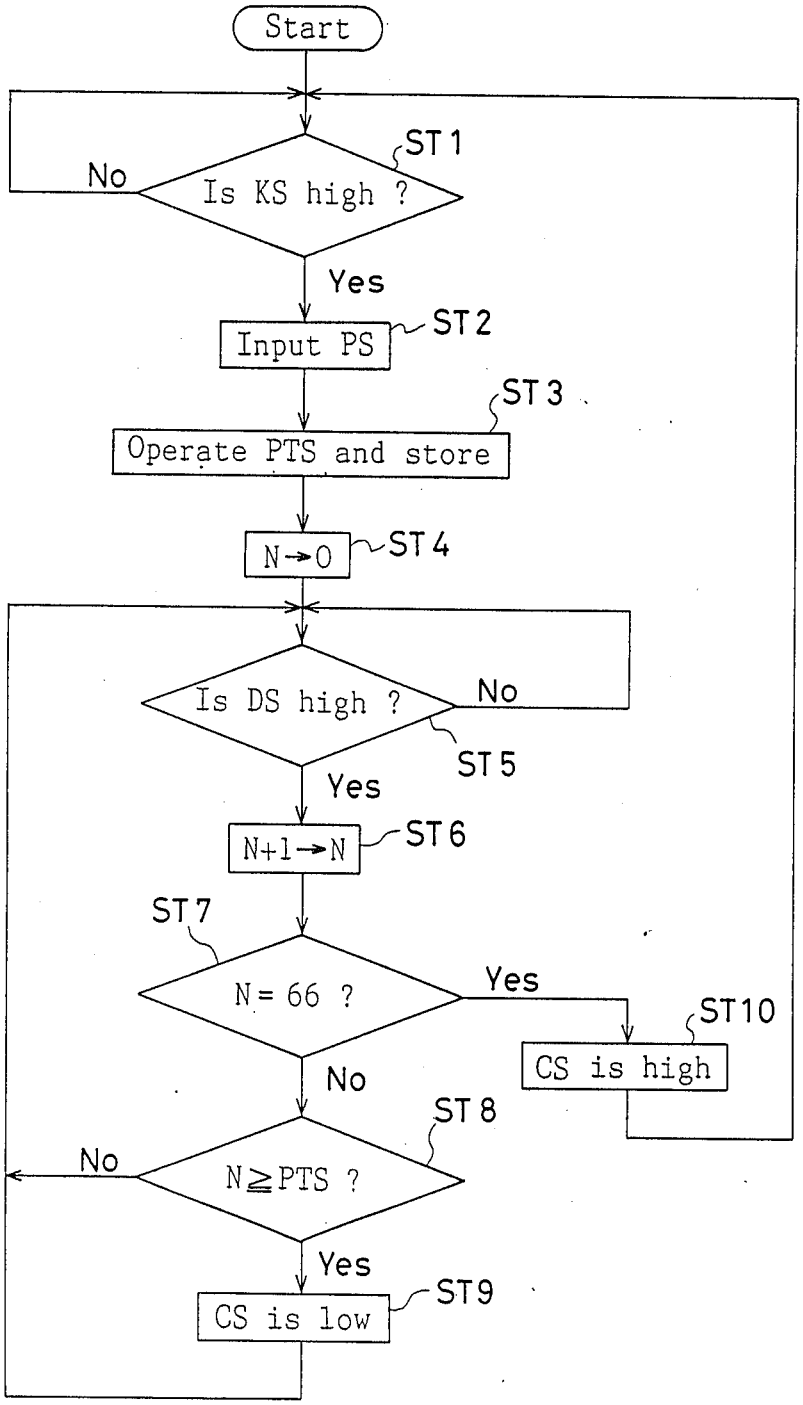
FIG. 10 is a flow chart showing operation of an arithmetic operation controlling apparatus of the above-mentioned needle thread supply control system.
Figure 11:
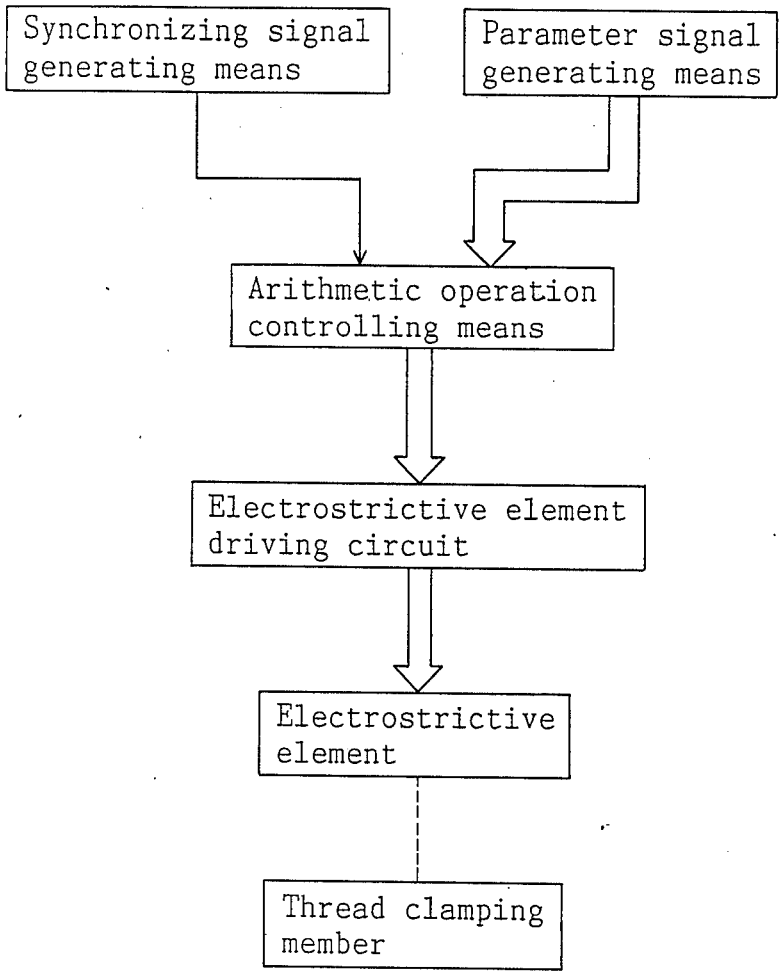
FIG. 11 is a view corresponding to claims of the present invention.

Here, when a start-stop switch (not illustrated) is operated, the synchronizing signal generator 112 generates the synchronizing signal DS attending on a rotation of the main shaft 22, and when the rotary phase of the main shaft 22 reaches 30°, the position detector 110 detects the first slit 106, supplying the high-level detection signal KS to the arithmetic operation controller 118. When the high-level detection signal KS is supplied, the arithmetic operation controller 118 discriminates that the detection signal KS has changed to the high level in step ST1 as shown in FIG. 10, inputting the parameter signal PS in step ST2. Then, in step ST3, the arithmetic operation controller 118 operates a parameter correspond signal PTS equivalent to the same numeric value as the number of the synchronizing signal DS generated from that point, that is, where the rotary phase of the main shaft 22 reaches 30° to the point where the eye 48 of the needle 10 advances half the thickness of the work fabric 37 according to the input parameter signal PS corresponding to the thickness of the work fabric 37, storing the parameter correspond signal PTS in the inner register. Next, in step ST4, arithmetic operation controller 118 sets the value of a variable N to (0), and in step ST5, it discriminates whether or not the high-level synchronizing signal DS has been supplied, and when discriminating that the high-level synchronizing signal DS has been supplied, in step S16, it adds (1) to the value (0) of the variable N, storing that value of the variable N. Next, in step ST7, the arithmetic operation controller 118 discriminates whether or not the stored value of the variable N is (66), and because the value of the variable N is not (66), in step ST8, it compares the stored value of the variable N with the value of the parameter correspond signal PTS being the content of the inner register. Then, because the value of the variable N is smaller than the parameter correspond signal PTS, it discriminates whether or not the synchronizing signal DS has gone high again in step ST5. Thus, the arithmetic operation controller 118 repeats the operation in step ST5 to step ST8, and increases the value of the variable N one after another and stores. Then, the value of the parameter correspond signal PTS is sure to be smaller than (66), and therefore when the eye 48 of the needle 10 advances half the thickness of the work fabric 37, the arithmetic operation controller 118 discriminates that the stored value of the variable N has agreed with the value of the parameter correspond signal PTS in step ST8, generating the control signal CS with the low level set in step ST9.

In the electrostrictive element driving circuit 120, since the low-level control signal CS is supplied to the base of the transistor 122, the transistor 122 is put in the off-state, and the transistors 132 and 136 are supplied with the base currents, being put in the on-state. Thereby, the base current of the transitor 144 is cut and the transistor 144 is put in the off-state. Furthermore, because the above-mentioned transistor 122 is in the off-state, the transistor 152 is supplied with the base current, being put in the on-state. This means that the first electric circuit 148 is opened and the second electric circuit is closed, and the electrostrictive element 100 is discharged (the electrostrictive deformation is released) through the resistor 150 and the transistor 152, and the increased dimension is restored. Then, since the dimension of the electrostrictive element 100 is restored, the needle thread clamping device 36 is not affected by it, clamping the needle thread 32 by the spring force of the spring 52. Thus, the supply of the needle thread 32 is allowed by the needle thread clamping device 36 until the eye 48 of the needle 10 reaches the vicinity of the surface of the work supporting bed of the sewing machine, that is, nearly the center position of the work fabric 37 in the direction of thickness, but when the eye 48 reaches the vicinity of the surface of the work supporting bed of the sewing machine, the needle thread 32 is clamped by the needle thread clamping device 36, and the supply thereof is stopped. At the same time, the take-up lever 42 is positioned at the upper most position while the needle thread 32 is allowed to be drawn out by the needle thread clamping device 36. This means that the needle thread 32 is consumed exclusively by the feed of the work fabric 37 and the descent of the eye 48 to the vicinity of the surface of the work supporting bed. The needle thread clamping device 36 allows the supply of the needle thread 32 and the take-up lever 42 is positioned at the uppermost position thereof only for such a period of consumption of the needle thread 32, and thereby the needle thread 32 is drawn out by the amount of actual consumption against a slight sliding resistance to the extent that the thread does not come loose, and an extra draw-out of the needle thread 32 by the needle thread clamping device 36 after completion of the period of consumption of the needle thread is prevented.

When the needle thread 32 is clamped by the needle thread clamping device 36 in such a manner, the take-up lever 42 starts to descend and moves following a predetermined motion curve. This motion of the take-up lever 42 is for giving a necessary and sufficient looseness of the needle thread 32 required for the descent of the needle 10 and the intertwining with a bobbin thread 35 while the needle thread is clamped. In this connection, among the motions of the take-up lever 42, a motion from the point of clamping the needle thread 32 to a point A in FIG. 3, that is, the point where the knife tip of the bobbin case catches a ring of the needle thread corresponds to a curve showing half the required amount of the needle thread 32 attending on up-down motion of the needle bar 12, and a motion from the point A to the point where the needle thread 32 is released corresponds to a curve showing half the amount of the bobbin thread required for the motion of the bobbin case (not illustrated).

While the take-up lever 42 moves in such a manner, the arithmetic operation controller 118 repeats the operations in steps ST5 to ST9 again as described above, and counts the number of the synchronizing signal DS, storing it as the increasing variable N. Then, in FIG. 3, when the rotary phase of the main shaft 22 reaches 360°, that is, immediately after the take-up lever 42 has reached the uppermost position thereof and tightened the needle thread ring formed at the eye 48 of the needle 10 and a nodule of the needle thread 32 and the bobbin thread 35 has been formed, the arithmetic operation controller 118 adds (1) to the value of the variable N and stores that value of the variable N as 66 in step ST6. Then, in step ST7, when the arithmetic operation controller 118 discriminates that the value of the numeral N has reached (66), it supplies the high-level control signal CS to the electrostrictive element driving circuit 120 in step ST10.

When the high-level control signal CS is supplied to the electrostrictive element driving circuit 120 in such a manner, the electrostrictive element driving circuit 120 puts the first electric circuit 148 in the on-state and puts the second electric circuit 156 in the off-state as described above, and therefore the electrostrictive element 100 is charged through the first electric circuit 148 and is displaced, and the dimension thereof is increased. Then, by that displacement, the needle thread clamping device 36 releases the needle thread 32.

Figure 4:
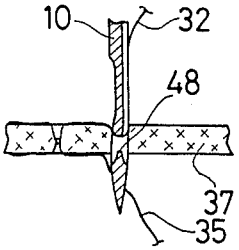
FIGS. 4 and 5 are views showing the state of forming seams by the above-mentioned sewing machine responding the thickness of work fabric, respectively.

As described above, when the needle bar 12, the feed dog 9, the needle thread clamping device 36, the take-up lever 42 and the like are moved in timing with the rotation of the main shaft 22, seems as shown in FIG. 4 are obtained. This means that the supply of the needle thread 32 is allowed by the needle thread clamping device 36 and the take-up lever 42 is positioned at the uppermost position thereof only for a period of consumption of the needle thread 32, and thereby the needle thread 32 is drawn out by the amount of actual consumption, and an extra draw-out of the needle thread 32 is prevented by the needle thread clamping device 36 after completion of such a period of consumption of the needle thread 32, and therefore a suitable seam is obtained that the nodule of the needle thread 32 and the bobbin thread 35 is positioned at the center part of the work fabric 37 in the direction of thickness.

Figure 5:
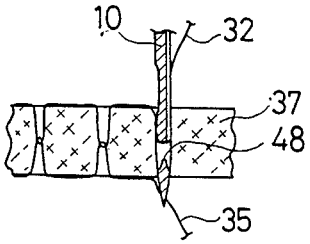

Also, when the thickness of the work fabric 37 differs, the high position of the presser bar 26 in the state of pressing the work fabric 37 differs, and therefore the rotary position of the gear 94 engaged with the rack 96 installed in the presser bar 26 also differs. Accordingly, the parameter signal PS generated by the parameter signal generator 114 differs, and the value of the parameter correspond signal PTS arithmetic-operated according to the parameter signal PS differs. For this reason, as shown by a broken line in FIG. 3, the timing of clamp and release of the needle thread clamping device 36 is shifted to the earlier side with increase in thickness. Thereby, as shown in FIG. 5, the nodule of the needle thread 32 and the bobbin thread 35 is positioned at the center of the work fabric 37 in the direction of thickness independent of the thickness of the work fabric 37. A broken line in FIG. 3 shows the case where, for example, the work fabric 37 is about 5 mm in thickness, and in this case, the needle thread clamping device 36 is closed when the eye 48 of the needle 10 is positioned at the position about 2.5 mm high from the surface of the work supporting bed of the sewing machine (B in FIG. 3). In addition, a full line in FIG. 3 shows the case where the work fabric 37 is thin to the extent of about 0 mm, and the eye 48 of the needle 10 is positioned at the position of the same height as that of the surface of the work supporting bed of the sewing machine.

Thus, in accordance with this embodiment, the supply of the needle thread 32 is allowed by the needle thread clamping device 36 and the take-up lever 42 is positioned at the uppermost position thereof only for a period of consumption of the needle thread 32, and thereby the needle thread 32 is drawn out by the amount of actual consumption, and an extra draw-out of the needle thread 32 by the needle thread clamping device 36 after completion of the period of such a consumption of the needle thread 32 is prevented. Also, the period of clamp of the needle thread 32 by the needle thread clamping device 36 is controlled in response to the thickness of the work fabric 37. Therefore, the nodule of the needle thread 32 and the bobbin thread 35 is positioned at the center part of the work fabric 37 in the direction of thickness and thereby a suitable seam is obtained independent of various conditions affecting the needle thread supply control such as the type of the work fabric 37, the type and thickness of the needle thread 32 or the bobbin thread 35, the width of seam, the length of seam and the type of pattern.

Also, in accordance with this embodiment, a spring arm 58 is installed in the second guide 40, and therefore this gives an advantage of preventing a cut of the needle thread 32 even if the tension of the needle thread 32 rises high temporarily. This means that the point where the necessary amount of the needle thread 32 for the motion of the needle bar 12 is required nearly agrees with the point when the eye 48 reaches the surface of the work supporting bed, but when the work fabric 37 is thick, the needle thread clamping device 36 clamps the needle thread 32 when the eye is positioned at the center of the fabric thickness, and therefore the necessary amount of the needle thread 32 for the motion of the needle bar 12 is required from this point. However, the take-up lever 42 stops at the uppermost position until the eye 48 reaches the surface of the work supporting bed, and therefore a temporary rise in the tension of the needle thread 32 can not be avoided after clamping by the needle thread clamping device 36. Normally, a rise in the tension is absorbed by expansion and contraction of the needle thread 32, but when the needle thread 32 having a small elasticity is used, the thread might be cut, and therefore in such a case, the above-mentioned spring arm 58 acts suitably to supply the temporary shortage of the amount of the thread, and a rise in the tension is alleviated.

What is claimed is:

1. An automatic needle thread supply control system for a sewing machine having a needle thread supplying path from a thread supplying source to an eye of a needle through a thread take-up member, a fabric feeding member feeding a work fabric while the needle is positioned above the surface of a work supporting bed in timing with up-down motion of the needle, and a presser bar provided with a presser foot pressing the work fabric against the surface of the work supporting bed, and forming a nodule of a needle thread and a bobbin thread in the work fabric by tightening a loop of needle thread formed at the eye of said needle, wherein said automatic needle thread supply control system is characterized by comprising:

a synchronizing signal generating means generating a synchronizing signal in synchronism with up-down motion of said needle, a parameter signal generating means generating a parameter signal on various conditions of sewing, a needle thread clamping device operating for supply and withholding of said needle thread to said thread take-up member from said thread supplying source, an electrostrictive element operatively connected to the needle thread clamping device to operate said clamping device, an arithmetic operation controlling means generating a control signal for controlling supply and withholding of said needle thread based on said parameter signal and said synchronizing signal, and an electrostrictive element driving circuit which has a first electric circuit for electrostrictively deforming said electrostrictive element by applying a voltage thereto and a second electric circuit for releasing the electrostrictive deformation of said electrostrictive element, and in which both electric circuits are driven according to said control signal.

2. An automatic needle thread supply control system for a sewing machine in accordance with claim 1, wherein said synchronizing signal generating means is constituted with a plurality of slits formed in a disc fixed to a main shaft of the sewing machine and an optical type detector detecting those slits.

3. An automatic needle thread supply control system for a sewing machine in accordance with claim 1, wherein said parameter signal generating means is constituted with a rack installed in said presser bar, a gear engaging with said rack and a potentiometer, and generates a parameter signal responding to the fabric thickness.

4. An automatic needle thread supply control system for a sewing machine in accordance with claim 1, wherein said electrostrictive element is constituted with a lamination type piezoelectric ceramics having a high-speed response.

5. An automatic needle thread supply control system for a sewing machine in accordance with claim 1, wherein said arithmetic operation controlling means controls the time of starting supply of said needle thread based on said synchronizing signal, and controls the time of stopping the supply of said needle thread in response to said parameter signal.

6. An automatic needle thread supply control system for a sewing machine in accordance with claim 1, wherein said electrostrictive element driving circuit is constituted with a switching circuit consisting of a combination of a plurality of transistors.

7. A sewing machine providing a needle thread supplying path from a thread supplying source to an eye of a needle through a thread take-up member and forming a nodule of a needle thread and a bobbin thread in a work fabric by tightening a loop of needle thread formed at an eye of said needle, wherein an automatic needle thread supply control system is characterized by comprising:

a synchronizing signal generating means generating a synchronizing signal in synchronism with rotation of a main shaft of the sewing machine, a parameter signal generating means generating a parameter signal on various conditions of sewing, a needle thread clamping device operating for performing supply and withholding of said needle thread to said needle take-up member from said needle supplying source, an electrostrictive element operatively connected to said needle thread clamping device to operate said needle thread clamping device, an arithmetic operation controlling means generating a control signal for controlling supply and withholding of said needle thread based on said parameter signal and said synchronizing signal, and an electrostrictive element driving circuit which has a first electric circuit for charging an electrostrictive element by applying a voltage to said electrostrictive element and a second electric circuit for discharging the charged electrostrictive element, and in which both electric circuits are closed and opened according to said control signal.

* * * * *